US007593510B2

(12) United States Patent
Rothschild

(10) Patent No.: US 7,593,510 B2
(45) Date of Patent: Sep. 22, 2009

(54) X-RAY IMAGING WITH CONTINUOUSLY VARIABLE ZOOM AND LATERAL RELATIVE DISPLACEMENT OF THE SOURCE

(75) Inventor: Peter J. Rothschild, Newton, MA (US)

(73) Assignee: American Science and Engineering, Inc., Billerica, MA (US)

( * ) Notice: Subject to any disclaimer, the term of this patent is extended or adjusted under 35 U.S.C. 154(b) by 0 days.

(21) Appl. No.: 12/255,956

(22) Filed: Oct. 22, 2008

(65) Prior Publication Data

US 2009/0103686 A1 Apr. 23, 2009

Related U.S. Application Data

(60) Provisional application No. 60/982,099, filed on Oct. 23, 2007.

(51) Int. Cl.
*G21K 1/04* (2006.01)

(52) U.S. Cl. ..... 378/160; 378/146

(58) Field of Classification Search ..... 378/145–160
See application file for complete search history.

(56) References Cited

U.S. PATENT DOCUMENTS

| | | | | |
|---|---|---|---|---|
| 2,825,817 | A | 3/1958 | North | 250/105 |
| 3,569,708 | A | 3/1971 | Weinbaum et al. | 250/83.3 |
| 3,868,506 | A | 2/1975 | Osigo | 250/278 |
| RE28,544 | E | 9/1975 | Stein et al. | 250/369 |
| 3,928,765 | A | 12/1975 | Teller | 250/272 |
| 4,047,029 | A | 9/1977 | Allport | 250/273 |
| 4,052,617 | A | 10/1977 | Garrett et al. | 250/360 |
| 4,342,914 | A | 8/1982 | Bjorkholm | 378/99 |
| 4,458,152 | A | 7/1984 | Bonora | 250/353 |
| 4,768,214 | A | 8/1988 | Bjorkholm | 378/87 |
| 4,799,247 | A | 1/1989 | Annis et al. | 378/87 |
| 4,864,142 | A | 9/1989 | Gomberg | 250/390.04 |
| 4,884,289 | A | 11/1989 | Glockmann et al. | 378/57 |
| 4,974,247 | A | 11/1990 | Friddell | 378/90 |
| 5,002,397 | A | 3/1991 | Ingrum et al. | 356/407 |
| 5,014,293 | A | 5/1991 | Boyd et al. | 378/197 |
| 5,022,062 | A | 6/1991 | Annis | 378/86 |
| 5,065,418 | A | 11/1991 | Bermbach et al. | 378/57 |
| 5,091,924 | A | 2/1992 | Bermbach et al. | 378/57 |
| 5,132,995 | A | 7/1992 | Stein | 378/56 |
| 5,179,581 | A | 1/1993 | Annis | 378/57 |
| 5,181,234 | A | 1/1993 | Smith | 378/87 |

(Continued)

FOREIGN PATENT DOCUMENTS

| | | |
|---|---|---|
| GB | 2287163 | 9/1995 |

(Continued)

*Primary Examiner*—Courtney Thomas
(74) *Attorney, Agent, or Firm*—Sunstein Kann Murphy & Timbers LLP

(57) ABSTRACT

An inspection system based on penetrating radiation in which the field of view of a scan may be varied. First and second primary limiting apertures are provided for interposition between a source of penetrating radiation and an inspected object. This allows for significantly increasing the flux of penetrating radiation on this narrowed region of interest, thereby advantageously improving detectability. The relative position of the source with respect to either the first or the second aperture may be varied, in a direction either along, or transverse to, a normal to the aperture.

15 Claims, 7 Drawing Sheets

U.S. PATENT DOCUMENTS

| | | | | |
|---|---|---|---|---|
| 5,224,144 | A | 6/1993 | Annis | 378/146 |
| 5,247,561 | A | 9/1993 | Kotowski | 378/87 |
| 5,253,283 | A | 10/1993 | Annis et al. | 378/100 |
| 5,302,817 | A | 4/1994 | Yokota et al. | 250/214 |
| 5,313,511 | A | 5/1994 | Annis et al. | 378/87 |
| 5,479,023 | A | 12/1995 | Bartle | 250/390.04 |
| 5,591,462 | A | 1/1997 | Darling et al. | 425/173 |
| 5,629,966 | A | 5/1997 | Dykster et al. | 378/57 |
| 5,638,420 | A | 6/1997 | Armistead | 378/57 |
| 5,692,028 | A | 11/1997 | Geus et al. | 378/57 |
| 5,692,029 | A | 11/1997 | Husseiny et al. | 378/88 |
| 5,764,683 | A | 6/1998 | Swift et al. | 378/57 |
| 5,838,759 | A | 11/1998 | Armistead | 378/57 |
| 5,903,623 | A | 5/1999 | Swift et al. | 378/57 |
| 6,067,344 | A | 5/2000 | Grodzins et al. | 378/117 |
| 6,094,472 | A | 7/2000 | Smith | 378/86 |
| 6,124,647 | A | 9/2000 | Marcus et al. | 307/10.1 |
| 6,151,381 | A | 11/2000 | Grodzins et al. | 378/90 |
| 6,249,567 | B1 | 6/2001 | Rothschild et al. | 378/88 |
| 6,252,929 | B1 | 6/2001 | Swift et al. | 378/57 |
| 6,292,533 | B1 | 9/2001 | Swift et al. | 378/57 |
| 6,424,695 | B1 | 7/2002 | Grodzins et al. | 378/87 |
| 6,658,087 | B2 | 12/2003 | Chalmers et al. | 378/86 |
| 6,727,506 | B2 | 4/2004 | Mallette | 250/394 |
| 7,010,094 | B2 | 3/2006 | Grodzins et al. | 378/86 |
| 2002/0097836 | A1 | 7/2002 | Grodzins | 378/57 |
| 2003/0091145 | A1 | 5/2003 | Mohr et al. | 378/58 |

FOREIGN PATENT DOCUMENTS

| | | |
|---|---|---|
| JP | 63079042 | 4/1988 |
| WO | WO 00/33060 | 6/2000 |
| WO | WO 00/37928 | 6/2000 |
| WO | WO 2004/043740 | 5/2004 |

X-RAY IMAGING WITH CONTINUOUSLY VARIABLE ZOOM AND LATERAL RELATIVE DISPLACEMENT OF THE SOURCE

The present application claims priority from U.S. Provisional Patent Application Ser. No. 60/982,099, filed Oct. 23, 2007, which is incorporated herein by reference.

TECHNICAL FIELD

The present invention relates to methods and systems for controlling the spatial resolution of imaging systems, and specifically to controlling the spatial resolution of such imaging systems by moving a source of radiation relative to an aperture.

BACKGROUND OF THE INVENTION

The present application contains subject matter related to that of US Published Patent Application US-2006-0245547, filed Mar. 21, 2006, which is incorporated herein by reference.

Current x-ray imaging systems typically make use of penetrating radiation characterized by a relatively wide-angle pattern that emerges from an x-ray generator such as an x-ray tube. Referring to the prior art configuration depicted in FIG. 1, the angular field of view A of the x-ray beam is conventionally determined by the angular extent P of an x-ray beam 14 emergent from x-ray source 10, in combination with any subsequent collimating structure 12. For example, in the situation depicted in FIG. 1, a wide-angle radiation pattern P emitted by x-ray source 10 and propagating toward the object under inspection 16 is blocked by a highly attenuating material 13 with a stationary collimating aperture 12 that transmits a fraction of the incident radiation in the form of a small fan beam 18. The term "opaque" refers herein to matter that does not effectively transmit the incident radiation. Here, the field-of-view A of x-ray radiation reaching the object 16 is determined by the angular size of the stationary aperture 12 viewed from the x-ray source 10. Referring to FIG. 2, in some cases, x-ray imaging systems may shape the emitted radiation into a scanning pencil beam by means of a chopper wheel 20, or otherwise. In such systems, a continuously moving collimator (or spatial modulator) 20, usually in the form of an opaque rotating wheel with appropriately placed aperture(s) 22, sequentially selects small portions from the wide-angle radiation pattern P emitted by x-ray source 10, positioned at a fixed distance L away from the collimator, and scans the object under inspection (OUI) 16 with a beam B, the transitory position 23 of which on the OUI 16 is accurately knows as a function of time. As used herein and in any appended claims, the term "quasi-collimation" refers to limiting the spatial extent of radiation by means of a single aperture, and, in that sense, beam B is quasi-collimated. As a result of such scan, a backscatter image may be created point-by-point by collecting backscattered radiation from each irradiated pixel for each collimator scan cycle.

For purposes of the current description, a field-of-view (FOV) is defined as the angular extent of an aggregate image comprised by a sequence of transitory illuminating spots formed by an aperture traversing the pattern of penetrating radiation, as viewed from the source. "Imaging" generally refers to generation of a multidimensional representation of values characterizing an aspect of an object or a scene, whether as a stored array or as a displayed representation. "Penetrating radiation" refers to probe radiation, such as in the x-ray portion of the electromagnetic spectrum, which passes into an object, not necessarily traversing the object, and which allows interrogation of various features of the object by virtue of interaction of the probe radiation with the object. "Scanning" a radiation pattern refers to moving a beam of the radiation in a systematic fashion.

"Pencil-shaped," as used herein, refers to a beam having any cross-sectional shape, the extent of each dimension of the cross-section, transverse to the beam propagation direction, being comparable, though not necessarily equal. "Flux," as used herein and in any appended claims, refers to either the number, or total power, of x-ray photons crossing a unit cross-sectional area per unit of time.

In prior art scanning x-ray inspection systems of FIGS. 1 and 2, the overall field-of-view, as defined by the span of the radiation-traversing motion of the aperture(s) 22, the angular field-of-view A, is fixed, since it is provided by an x-ray tube's focal spot 11 (shown in FIG. 1), beam forming aperture(s) 12 and 22, and predetermined distance L, all designed to suit a specialized objective. The fixed FOV limits such system to a narrow range of uses, and typically precludes imaging objects outside of a particular design distance, or range of distances, to the OUI 16. An object at a distance shorter than the design distance is "cut-off", while an object more distant that the design distance suffers resolution loss.

SUMMARY OF THE INVENTION

In accordance with preferred embodiments of the present invention, methods and apparatus are provided for varying the field-of-view of imaging systems that have a source of penetrating radiation and a first and second aperture disposed in the path of the penetrating radiation. The field of view is varied, in accordance with preferred embodiments of the invention, by repositioning the source of radiation with respect to the apertures shaping the beam. As a result of varying the FOV, the areal resolution of x-ray imaging can be controlled. In particular, a translator is provided for repositioning the source relative to the first aperture transversely with respect to the path of emitted radiation.

In further embodiments, methods and apparatus are provided for varying the flux of penetrating radiation incident on a target for any instant FOV. This is achieved by changing the spectral, temporal, or spatial characteristics of the beam. According to yet other preferred embodiments of the invention, methods and apparatus are provided for scanning a target in a raster fashion. This may be achieved by repositioning the relative positions of the source of radiation and the aperture in a plane transverse to the optical axis of the system.

In various embodiments, the source of penetrating radiation may be an x-ray tube or, alternatively, it may be a radioactive source, or an accelerator. The spatial modulator may include one or more rotating chopper wheels.

BRIEF DESCRIPTION OF THE DRAWINGS

The foregoing features of the invention will be more readily understood by reference to the following detailed description taken with the accompanying drawings.

DETAILED DESCRIPTION OF THE EMBODIMENT OF THE INVENTION

For the purposes of the current invention, the term "zoom" refers to user-defined control of an imaging system's FOV, concurrently implicating control of the areal resolution of the imaging system. "Areal resolution" refers to the resolution corresponding to the inspection of an object as projected onto a plane. A "normal" to an aperture is defined as a direction perpendicular to a plane containing the aperture.

Figure 1:
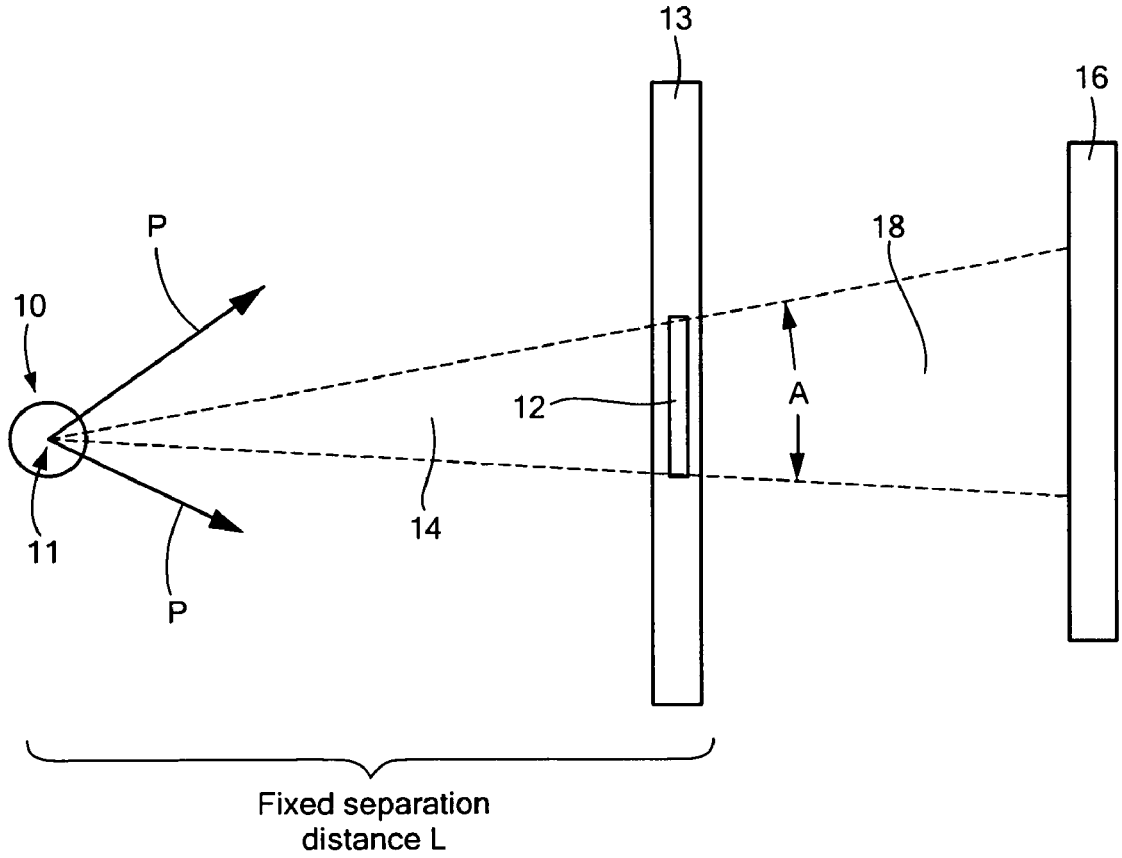
FIG. 1 PRIOR ART
FIG. 1 is a schematic illustration of a prior art stationary x-ray imaging system.
Figure 2:
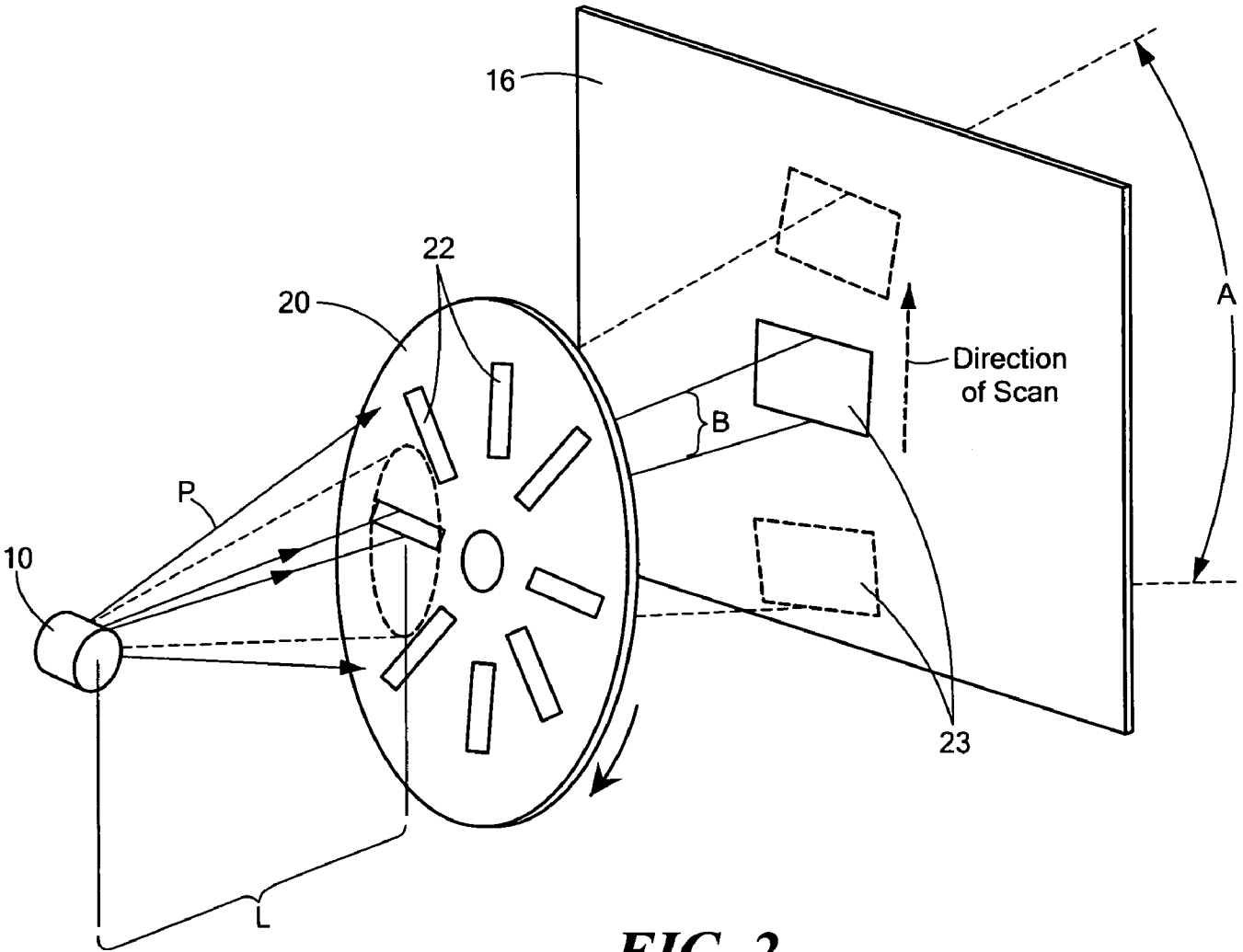
FIG. 2 PRIOR ART
FIG. 2 shows a perspective view of a prior art scanning x-ray imaging system and illustrates a general definition of a FOV.
Figure 3A:
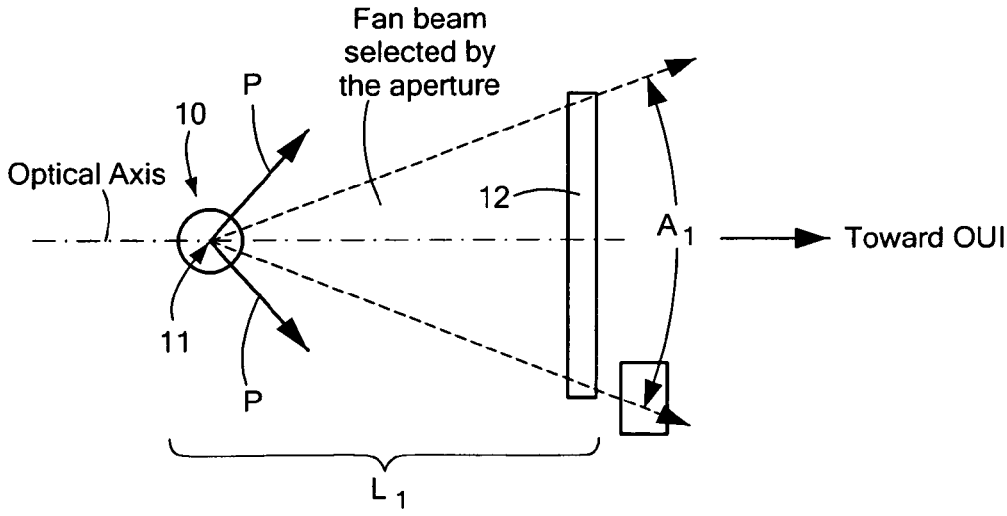
FIGS. 3A and 3B schematically illustrate principles of changing a FOV according to an embodiment of the current invention.
Figure 3B:
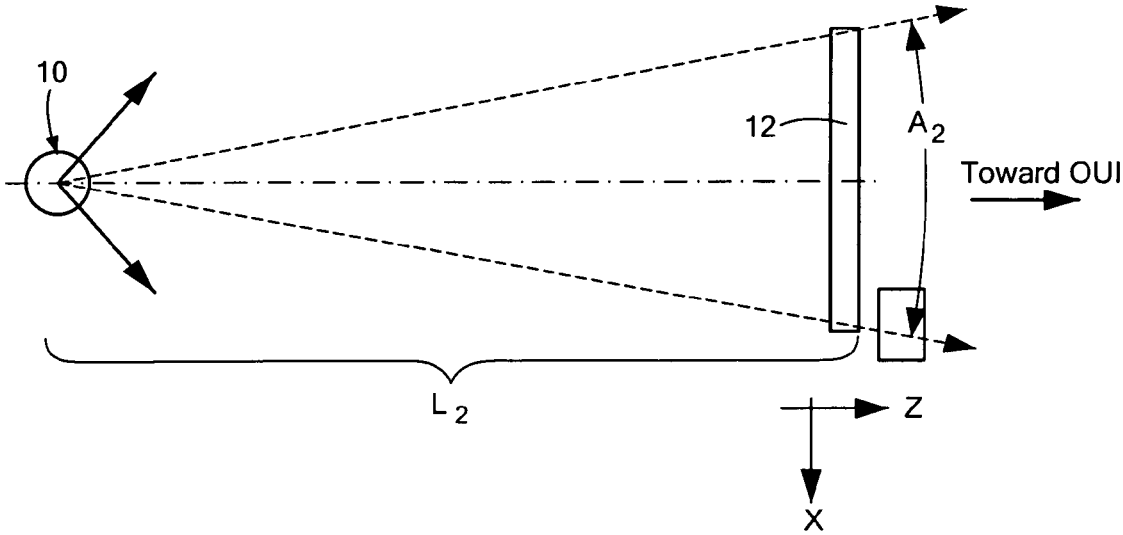

The angular FOV of a system comprising a source of radiation and governed by ray optics is determined by the dimensions and any scanning limits of a field stop of the system in conjunction with the separation between the source and the field stop. With reference to FIGS. 3A and 3B, embodiments of the current invention allow the FOV of an x-ray imaging system to be varied continuously, either automatically or by an operator, by moving x-ray source 10 toward, or away, from a field stop (i.e., a beam forming aperture) by use of an actuator (designated generally by numeral 24 in FIG. 4). Source 10 provides penetrating radiation, and may be an x-ray tube, or a radioactive source, or any other source of penetrating radiation, including, for example, an accelerator, either electrostatic or linear. Actuator 24 may be a motor in conjunction with a worm drive, for example, or any other mechanism for translating the relative displacement between source 10 and a field stop. When source 10 and a beam-forming aperture 12 are separated by a short distance $L_1$ the angle of radiation emanating from the x-ray source and transmitted through the aperture, which functions as a field stop of the system, defines a wide field-of-view $A_1$ shown in xz-plane in FIG. 3A. Source 10 may be characterized by a focal spot 11 of energetic particles impinging upon a target to generate x-rays P. In a distant imaging set-up depicted in FIG. 3B, when the source 10 is positioned farther away from the aperture 12 at a distance $L_2>L_1$, aperture 12 subtends a smaller angle $A_2$ as viewed from the focal point of the source thus defining a correspondingly narrower FOV $A_2<A_1$. The ability to control the separation between the source and the beam-forming aperture allows controlling the spatial extent of the beam of radiation passing through the aperture toward the OUI and, thereby, managing the cross-section of a pencil-shaped beam scanned across the OUI. Consequently, the separation between the source 10 and the aperture 12 efficiently governs zooming, in or out, of x-ray imaging system of the OUI, allowing the smaller or the bigger portion of the OUI to be irradiated as a function of the source-to-aperture separation. It is understood that, in practice, the range of source motion and, therefore, zoom are limited, on one side to the maximum output angle allowed by the x-ray tube's construction, and on the other side to space limitations in the system. Flux constraints may also impose practical limitations.

While an x-ray beam B is scanning the object, either the object under inspection or the x-ray source and collimator may also be moved in a direction substantially orthogonal to the beam propagation direction. A two dimensional image of the object may be created by a combination of collimator scanning and real or virtual motion of the source and/or object.

Figure 4:
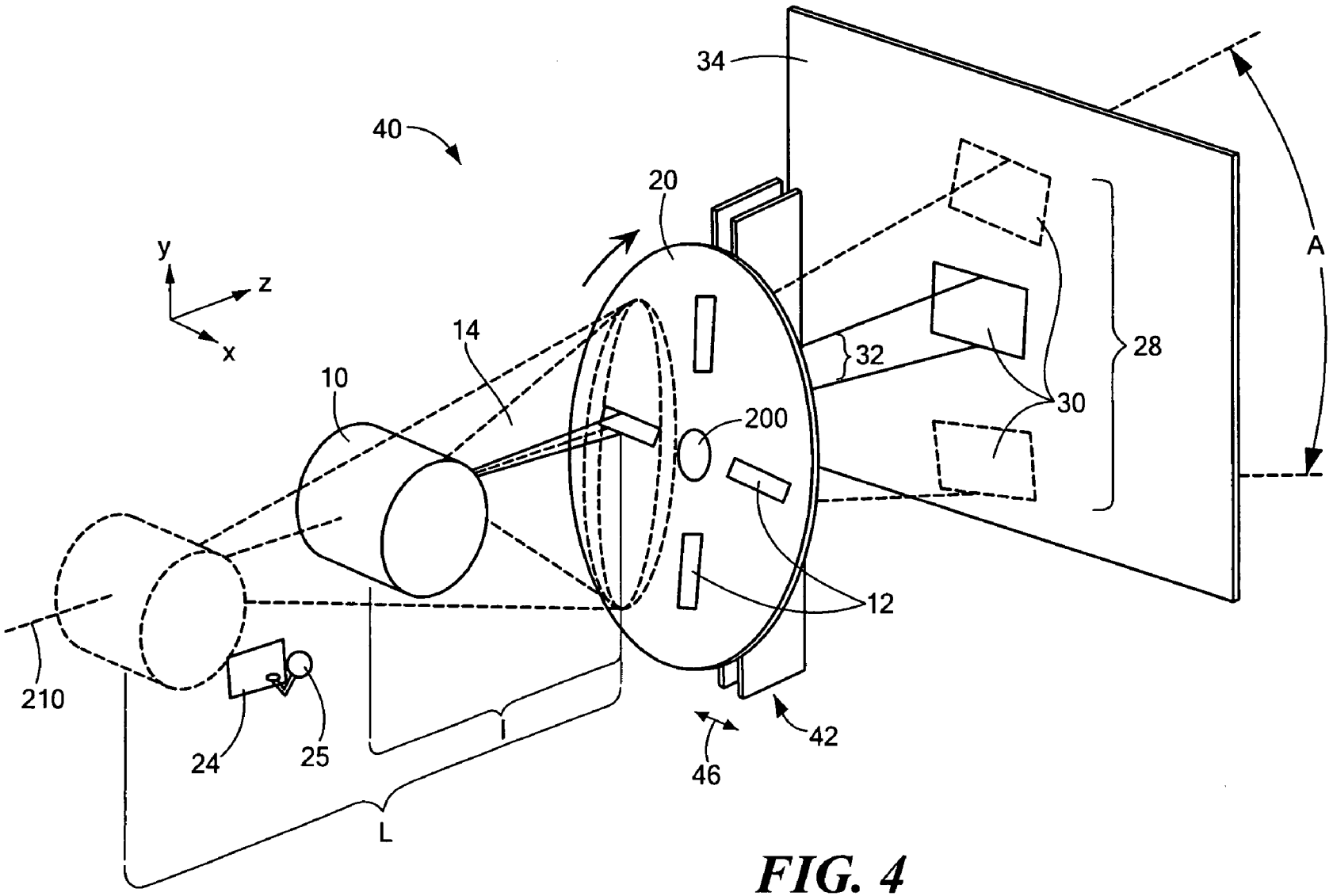
FIG. 4 provides a perspective view of the embodiment of FIG. 3 containing a rotating spatial modulator and limiting a field-of-view in two dimensions.

FIG. 4 depicts a variable-zoom scanning system 40, where apertures 12, forming successive field stops and shaping a beam by scanning a wide-angle pattern 14 of penetrating radiation emanating from source 10, are disposed on a spatial modulator in the form of a chopper wheel 20 rotating in the xy-plane about an axis 200. To constrain the spatial extent of the beam additionally in a transverse direction, a second collimating aperture stop 42 may be provided in the path of penetrating radiation. Source 10 is coupled to a translator 24. Translator 24 repositions the source 10 with respect to chopper 20 and, particularly, along and/or transverse to the normal 210 to apertures 12 of scanning system 40 using motor 25 or any other mechanical, electrical, pneumatic or other suitable means, optionally computerized.

Figure 5:
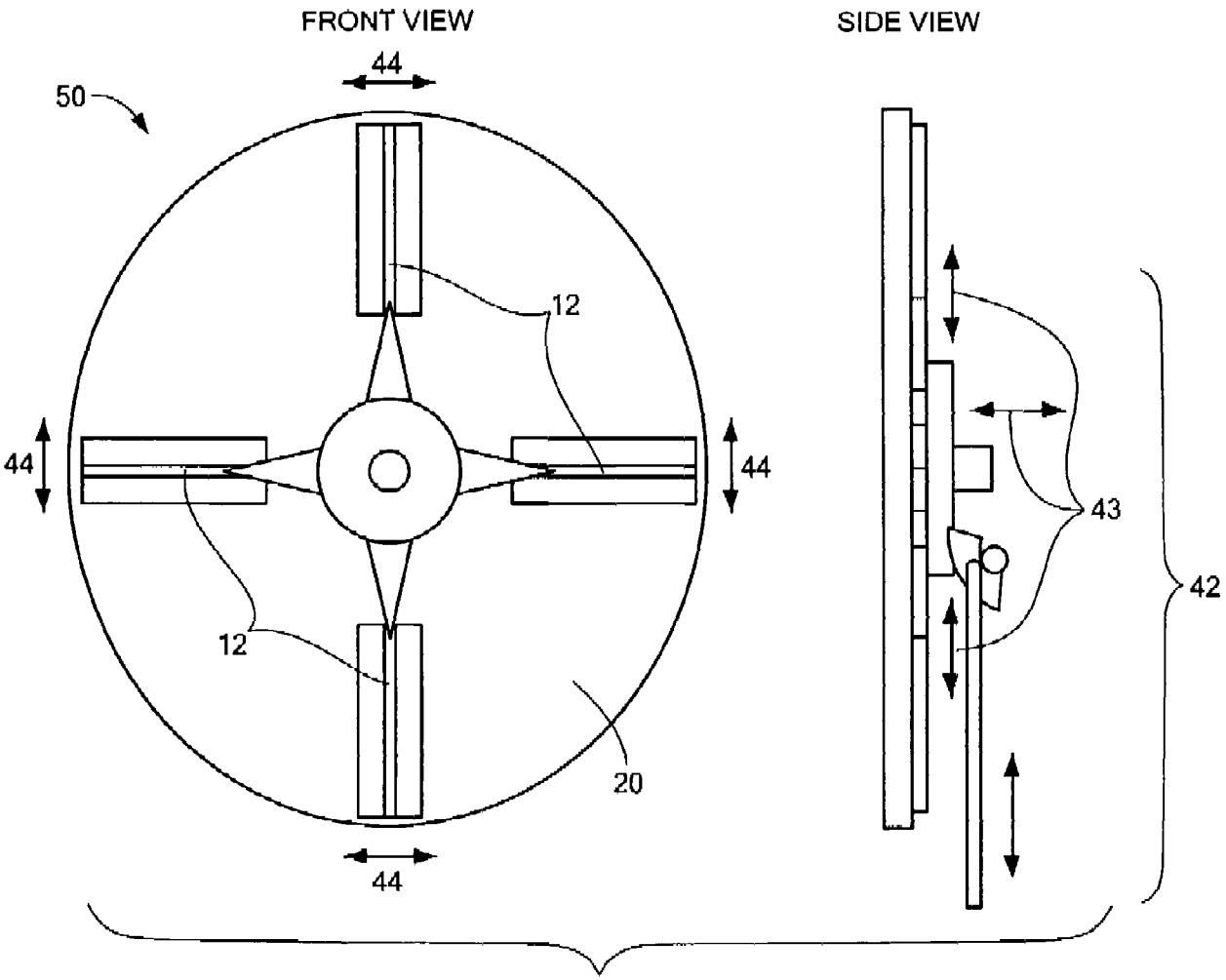
FIG. 5 shows front and top views of a spatial modulator with adjustable apertures according to the invention.

Field-of-view A (defined by the view, from source 10, of the angular extent of the image 28 that is comprised by the transitory illuminating spots 30 of the scanning apertures 12) is reduced by moving the source 10 away from the wheel 20 as shown in FIG. 4 (and, therefore, increasing the separation between the source and the wheel from $L_1$ to $L_2$), the output flux of penetrating radiation in a scanning beam 32 (which may have any specified cross-sectional shape, within the scope of the present invention), incident on the object under inspection OUI 34 at any instant of time, decreases as well. This is because a progressively smaller portion of wide-angle radiation pattern of the source 10 is being subtended by the one of the apertures 12. To improve grainy and statistically poor images that may result from reduced flux leading to insufficient irradiation of the object, or, otherwise, to adjust resolution, an embodiment 50 of the device of the invention, shown in FIG. 5 in front and side views, provides for ancillary variation of the flux of beam 32 of FIG. 4 by altering the transverse cross-section of the beam 32. As illustrated in FIG. 5, chopper wheel 20 may be equipped with a cam mechanism 42 having several degrees of operative freedom 43 that provide for user-defined adjustments 44 of the dimensions of the apertures 12. When the source 10 is positioned farther away from the wheel 20, and the FOV is reduced, the apertures 12 may be enlarged to allow more x-ray photons to traverse apertures 12. On the other hand, when the source 10 is moved closer to the wheel 20 and the FOV of the system is increased, the apertures 12 may be appropriately closed down to reduce the flux. Furthermore, the spatial extent of the beam in a transverse direction may be adjusted by providing suitable means 46 for varying the extent of the aperture stop 12 of FIG. 4, thereby improving spatial, or areal, resolution. As a result, the flux of penetrating radiation reaching the object and, therefore, the quality of the x-ray imaging, may be maintained across the zooming range of the system of the invention. The adjustments of the spatial extent of radiation according to the embodiment of FIG. 5 can be carried out at any instant of time and do not depend on instantaneous separation between the source and the chopper wheel.

Figure 6:
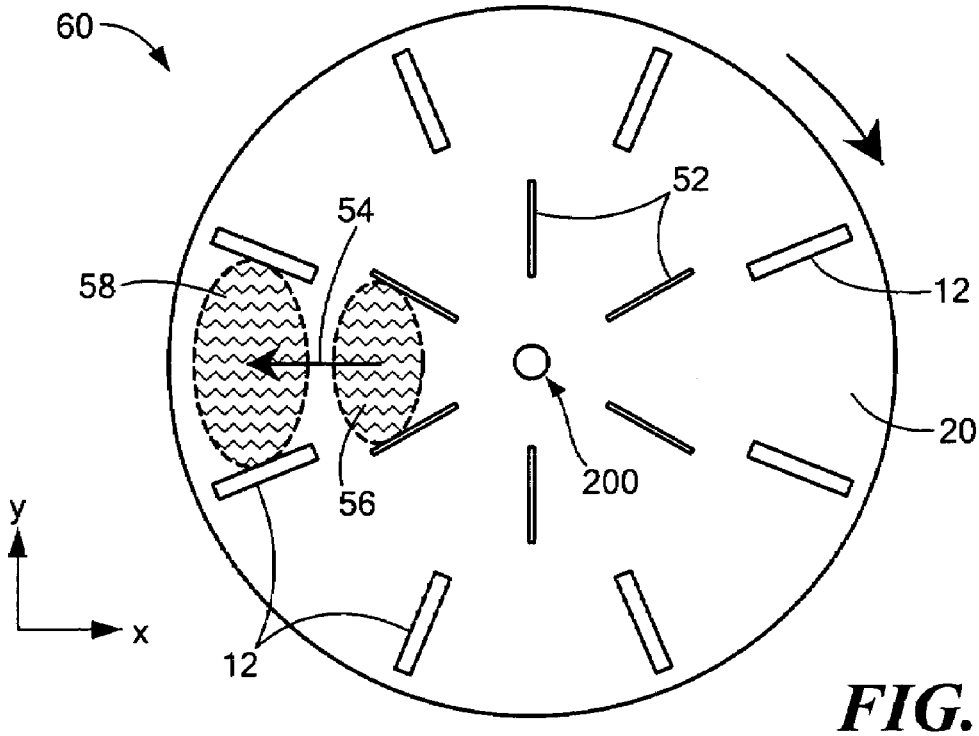
FIG. 6 shows a spatial modulator of the invention having two concentric sets of differently sized radially disposed apertures.
Figure 7:
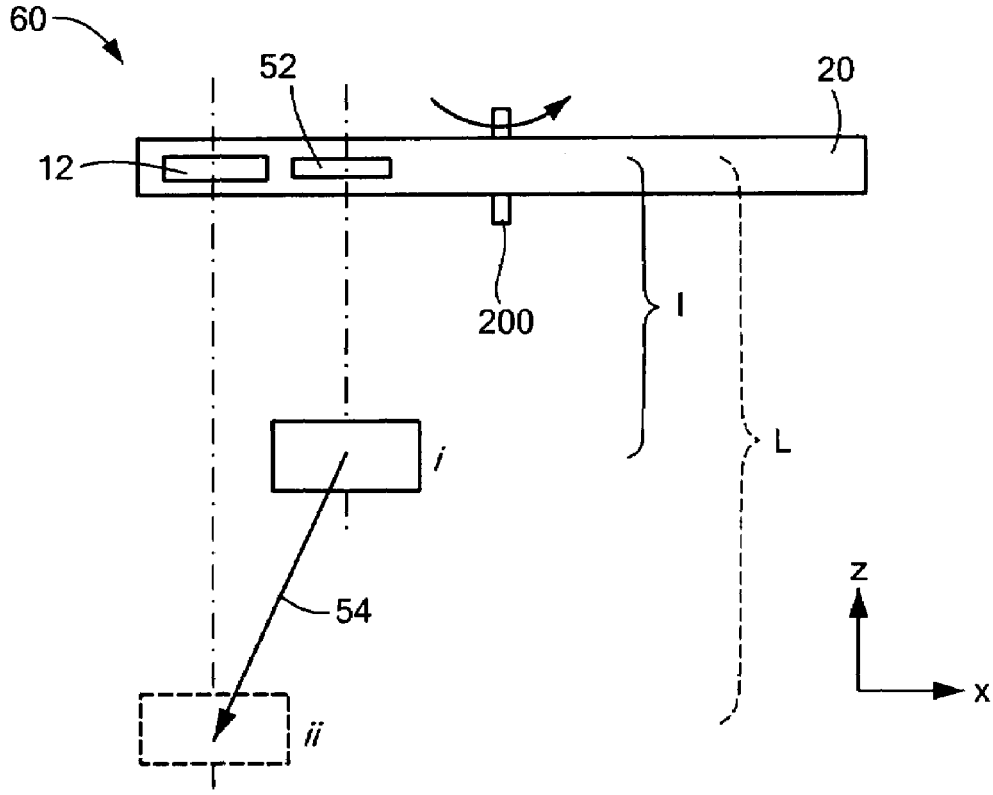
FIG. 7 provides a top view of the embodiment employing the spatial modulator of FIG. 6.

Alternatively, maintaining a throughput flux substantially unchanged across the zooming range of the system can be achieved with an embodiment 60, schematically depicted in FIG. 6. Here, wheel 20 contains a set of apertures 12 and is additionally furnished with a second set of apertures 52. The two sets of apertures are disposed concentrically and circularly at different radii with respect to the axle 200 defining the rotational axis of wheel 20, with the apertures 52 being appropriately smaller in extent than the apertures 12. As shown in FIG. 6, the rotating wheel 20 creates, therefore, two complementary zones of apertures for scanning the radiation incident upon the wheel. In operation, source 10 (not shown) of embodiment 60 is typically adapted for repositioning not only along the local optical axis of the system but also in the transverse direction, parallel to x-axis as shown in FIG. 6. For example, solely repositioning of the source 10, which is initially aligned for operation with the apertures 52, away from the wheel 20 (in −z direction of FIG. 6) reduces the FOV of the system and the flux captured by the apertures 52, as was discussed in reference to FIGS. 3 and 4. However, a simultaneous relative displacement of the source transversely to the axis 200 would suitably align the source with the set of apertures 12 having larger dimensions and capable of accepting more x-ray photons, thus compensating for the reduction of flux due to increased source-to-field-stop distance L of the system. Functionally, therefore, the embodiment 60 accommodates scanning of the incident radiation closer to the axis of rotation for a distant imaging (or small FOV use) and toward the edge of the wheel for near-field imaging (or wide FOV use). A complex displacement of the source 10 of embodiment 60 is indicated in FIG. 6 in projection on the plane of the wheel 20 with an arrow 54 and foot-prints 56 and 58 of the radiation pattern that correspond to the positions of the source 10 at shorter and longer distances l,L from the wheel, respectively. In FIG. 7, showing the embodiment 60 in top view, the initial and the final positions of the source 10 are respectively designated as i and ii. It is understood that having multiple sets of apertures at different radii on the spatial modulator 20 also provides additional flexibility in that, if space constraints do not allow the source 10 to be moved sufficiently far away from the modulator to cover the designed range of FOV, multiple sets of apertures help to recover a full range of zoom.

Figure 8:
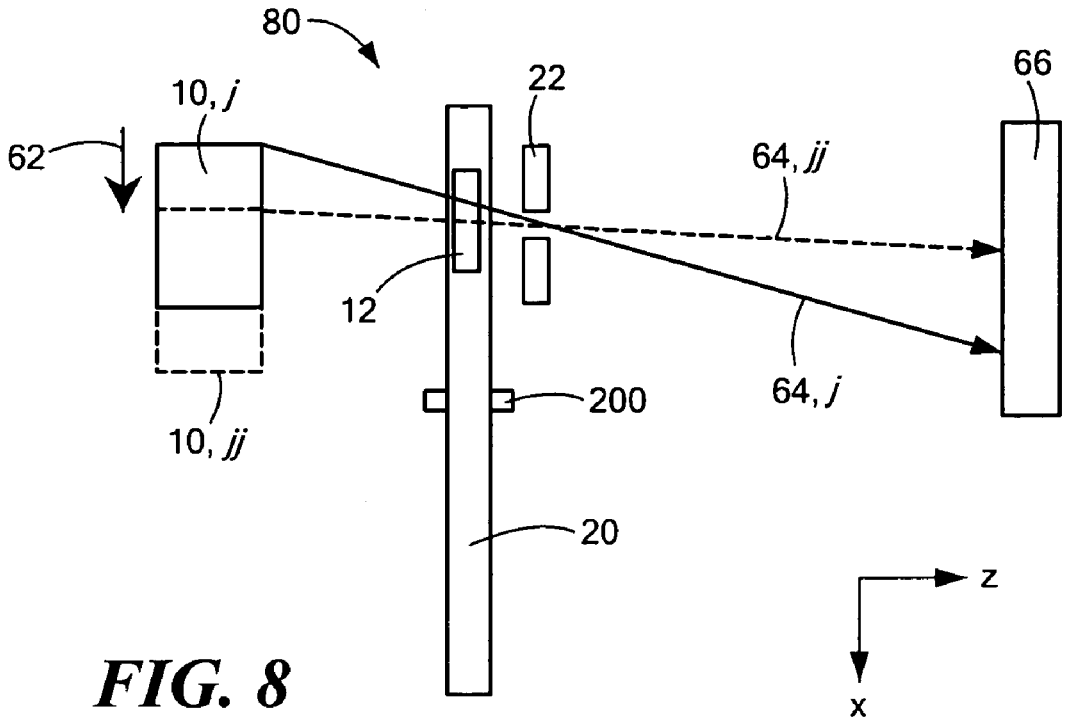
FIG. 8 demonstrates an embodiment of a raster-scanned x-ray imaging system in accordance with an embodiment of the invention.

Embodiments of the current invention may provide advantages over the prior art by moving an x-ray source in the direction transverse to the optical axis of the system. In the embodiment 80 of FIG. 8, for example, the source 10 is displaced perpendicularly to the z-axis from the position j to another position jj, as indicated by an arrow 62. A beam formed by the aperture(s) 12 of the wheel 20 and the collimator 22, tracks the motion of the source, as represented by the respective change in the orientation of the marginal ray from 64,*j* to 64,*jj*, and appropriately scans the target 66 in −x direction. Combined with scanning the radiation pattern in xy-plane due to rotation of the wheel 20 about axle 200, such transverse repositioning 62 of the source 10 generates a raster scan of the target 66. Although particularly suited for distant imaging, the use of this embodiment is not limited to that application.

In alternative embodiments of the present invention, the integration time of the detector of the imaging system may be synchronized with operator-modifiable speed of rotation of the wheel 20. Such simultaneous adjustment of the scanning speed and detection time helps maintaining both the image size and the flux reaching the detector substantially unchanged across full zooming range of the imaging system.

Figure 9:
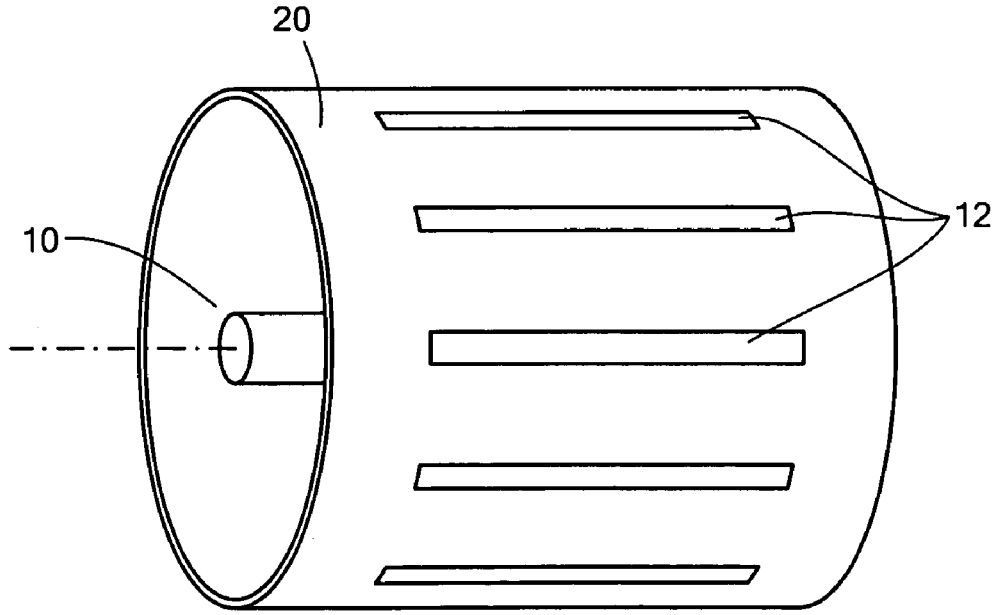
FIG. 9 illustrates an alternative embodiment of the invention with a spatial modulator in a cylindrical form.

All of the heretofore described embodiments of the invention are intended to be merely exemplary and numerous variations and modifications will be apparent to those skilled in the art. For example, a chopper 20 performing spatial modulation of penetrating radiation and forming it into a scanning beam may be in the form of cylindrical chamber, as shown in FIG. 9. The orientation of apertures of the spatial modulator and that of the collimator, as well as mutual positioning of the modulator and collimator with respect to source 10 can be varied as dictated by the experimental use of the system. The order, in which the apertures of the spatial modulator and the collimator are disposed in the path of penetrating radiation with respect to the source of penetrating radiation, can be varied. In this regard it should be understood that for the purposes of this disclosure the designations "first aperture" and "second aperture" are reciprocal. An additional aperture, functioning as a field stop of the system, either variable or fixed, can be disposed in the path of radiation prior to or after the modulator. Change of rotational speed of the spatial modulator, synchronization of the speed of rotation of the spatial modulator with the integration time of the detector, or motor driving the translator for repositioning the source may be computerized or otherwise user-defined. Also, to effect relative motion of the source with respect to beam-forming apertures, the source may remain stationary and the spatial modulator and the collimator can be moved with respect to the source. All such variations and modifications are intended to be within the scope of the present invention as defined in any appended claims.

What is claimed is:

1. A system for inspecting an object, the system comprising:

a source of penetrating radiation characterized by a radiation pattern;

a first aperture characterized by a first limiting extent in at least one dimension disposed in a path of emitted penetrating radiation, the path characterized by an axis;

a second aperture characterized by a second limiting extent in at least one dimension disposed in the path of emitted penetrating radiation;

and a translator for repositioning the source with respect to the first aperture, wherein at least one of source and the first and second apertures is movable transversely to the path of emitted penetrating radiation.

2. The system of claim 1, wherein the first aperture is adapted for traversing at least a fraction of the radiation pattern of the source.

3. The system of claim 2, wherein traversing includes scanning.

4. The system of claim 1, wherein the second aperture is disposed on a chopper wheel.

5. The system of claim 1, wherein at least one of the limiting extents is variable.

6. The system of claim 1, wherein the first limiting extent is defined transversely to the second limiting extent.

7. The system of claim 1, wherein repositioning includes moving the source along the normal to the first aperture.

8. The system of claim 1, wherein repositioning includes moving the source transversely to the normal to the first aperture.

9. The system of claim 1, wherein the source is an x-ray tube.

10. The system of claim 1, further including a detector for detecting the radiation after interaction with the object.

11. The system of claim 10, wherein the detector is a scatter detector.

12. The system of claim 10, wherein the detector is a transmission detector.

13. The system of claim 1, wherein the translator includes a user-defined input.

14. A method for inspecting an object in a continuous zoom mode, the method comprising:

disposing an aperture between a source of penetrating radiation and the object for defining a field of view of the emitted penetrating radiation, thereby creating a relative disposition of the aperture and the source of penetrating radiation, and varying the relative disposition of the aperture and the source of penetrating radiation in a direction transverse to a normal to the aperture in such a manner as to vary the field of view of the penetrating radiation.

15. A method in accordance with claim 14, wherein the step of varying the relative disposition of the aperture and the source of penetrating radiation includes additionally varying the relative disposition in a direction normal to the aperture.

* * * * *